US011312588B2

(12) United States Patent
Heineck

(10) Patent No.: US 11,312,588 B2
(45) Date of Patent: Apr. 26, 2022

(54) AUTOMATIC DOCUMENT FEEDERS

(71) Applicant: Hewlett-Packard Development Company, L.P., Spring, TX (US)

(72) Inventor: John Heineck, Boise, ID (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 113 days.

(21) Appl. No.: 16/650,672

(22) PCT Filed: Oct. 5, 2017

(86) PCT No.: PCT/US2017/055383
§ 371 (c)(1),
(2) Date: Mar. 25, 2020

(87) PCT Pub. No.: WO2019/070286
PCT Pub. Date: Apr. 11, 2019

(65) Prior Publication Data

US 2020/0223650 A1 Jul. 16, 2020

(51) Int. Cl.
*B65H 1/18* (2006.01)
*B65H 3/06* (2006.01)
*B65H 1/04* (2006.01)

(52) U.S. Cl.
CPC ..... *B65H 3/0684* (2013.01); *B65H 1/04* (2013.01); *B65H 1/18* (2013.01)

(58) Field of Classification Search
CPC ..... B65H 1/04; B65H 1/18; B65H 3/0684
See application file for complete search history.

(56) References Cited

U.S. PATENT DOCUMENTS

| | | | | |
|---|---|---|---|---|
| 2,381,430 | A | 8/1945 | Belluche | |
| 5,101,241 | A | 3/1992 | Watanabe | |
| 6,224,051 | B1 | 5/2001 | Nakayam et al. | |
| 6,234,076 | B1 | 5/2001 | Mizutani | |
| 7,753,365 | B2 | 7/2010 | Oshima | |
| 7,828,288 | B2 * | 11/2010 | Kim | B65H 29/50 271/200 |

(Continued)

FOREIGN PATENT DOCUMENTS

| | | |
|---|---|---|
| JP | 10167545 | 6/1998 |
| JP | 2005008283 | 1/2005 |
| JP | 2009044449 A | 2/2009 |

OTHER PUBLICATIONS

Toshiba Serive Manual Digital Malfunction E-studio 160/200/250, http://www.dotservice.ro/es ~ 2002 ~ 255 pages.

*Primary Examiner* — Howard J Sanders
(74) *Attorney, Agent, or Firm* — HP Inc. Patent Department

(57) ABSTRACT

An example automatic document feeder device includes a document tray, a pair of rollers, at least one controller that automatically adjusts a height of the document tray and the pair of rollers based on an amount of media contained on the document tray, Sand a slide aligned to the pair of rollers to alter a media pathway distance as the height of the pair of rollers changes. The controller may adjust the height of the document tray independently from adjusting the height of the pair of rollers. A guide may be provided adjacent to the document tray, wherein the guide may bend as the height of the document tray increases. A sensor may determine a thickness of media contained on the document tray.

14 Claims, 14 Drawing Sheets

(56) References Cited

U.S. PATENT DOCUMENTS

| | | | | |
|---|---|---|---|---|
| 8,827,263 | B1 | 9/2014 | Wu et al. | |
| 10,584,007 | B2 * | 3/2020 | Matsumura | B65H 1/04 |
| 10,737,896 | B2 * | 8/2020 | Ito | B65H 29/14 |
| 10,800,630 | B2 * | 10/2020 | Fujiwara | H04N 1/00602 |
| 10,841,440 | B2 * | 11/2020 | Miwa | H04N 1/00615 |
| 10,961,074 | B2 * | 3/2021 | Miwa | B65H 5/36 |
| 2005/0195450 | A1 * | 9/2005 | Shoji | H04N 1/00822 358/497 |
| 2008/0224392 | A1 * | 9/2008 | Oshima | B65H 1/14 271/265.04 |
| 2010/0033774 | A1 | 2/2010 | Ridl et al. | |
| 2012/0223475 | A1 | 9/2012 | Komuro | |
| 2013/0156484 | A1 | 6/2013 | Mandel | |
| 2016/0257517 | A1 | 9/2016 | Watanabe et al. | |
| 2019/0233239 | A1 * | 8/2019 | Shigeno | H04N 1/00631 |
| 2019/0238700 | A1 * | 8/2019 | Ito | B65H 29/50 |

* cited by examiner

AUTOMATIC DOCUMENT FEEDERS

BACKGROUND

An automatic document feeder permits sheets of paper to be inserted into a copier or scanner automatically without requiring a user to manually insert the sheets.

DETAILED DESCRIPTION

For machines such as enterprise scanners, customers are often looking for higher document feeder input capacity, especially for large scan jobs. In large capacity jobs containing dozens or even hundreds of sheets of paper, the automatic document feeder may need to be adjusted to accommodate the sheets. Typically, the entire height of the machine increases by the sum of the input height and output height of the automatic document feeder. When the entire machine's height increases, the raw material, shipping/packaging, and manufacturing costs similarly increase and the extra height often results in a chunky, and aesthetically displeasing configuration. The examples described herein provide a technique to adjust the input capacity of an automatic document feeder while also adjusting the output capacity of the printed/scanned/copied documents without increasing the total height of the automatic document feeder. The output rollers, through which the media; e.g., sheets of paper, etc. exits the printer/scanner moves up/down and possibly laterally according to the up/down movement of the automatic document feeder. As referred to herein, the term media may refer to one or more sheets of paper or any other media suitable for insertion into a machine such as a printer, scanner, copier, or fax machine, etc.

The examples described herein provide an automatic document feeder device comprising a document tray, a pair of rollers, at least one controller that automatically adjusts a height of the document tray and the pair of rollers based on an amount of media contained on the document tray, and a slide aligned to the pair of rollers to alter a media pathway distance as the height of the pair of rollers changes. In an example, the at least one controller is to adjust the height of the document tray independently from adjusting the height of the pair of rollers. In an example, the at least one controller comprises a first controller that automatically adjusts the height of the document tray, and a second controller that automatically adjusts the height of the pair of rollers.

According to an example, the automatic document feeder device comprises a guide adjacent to the document tray, wherein the guide is to bend as the height of the document tray increases. The slide comprises any of a flexible, stretchable, bendable, and telescoping slide, according to various examples. In an example, the automatic document feeder device comprises a slot retaining at least a portion of the slide, wherein the slide is to move with respect to the slot as the height of the pair of rollers changes. The automatic document feeder device comprises a sensor to determine a thickness of media contained on the document tray, according to an example.

Figure 1:
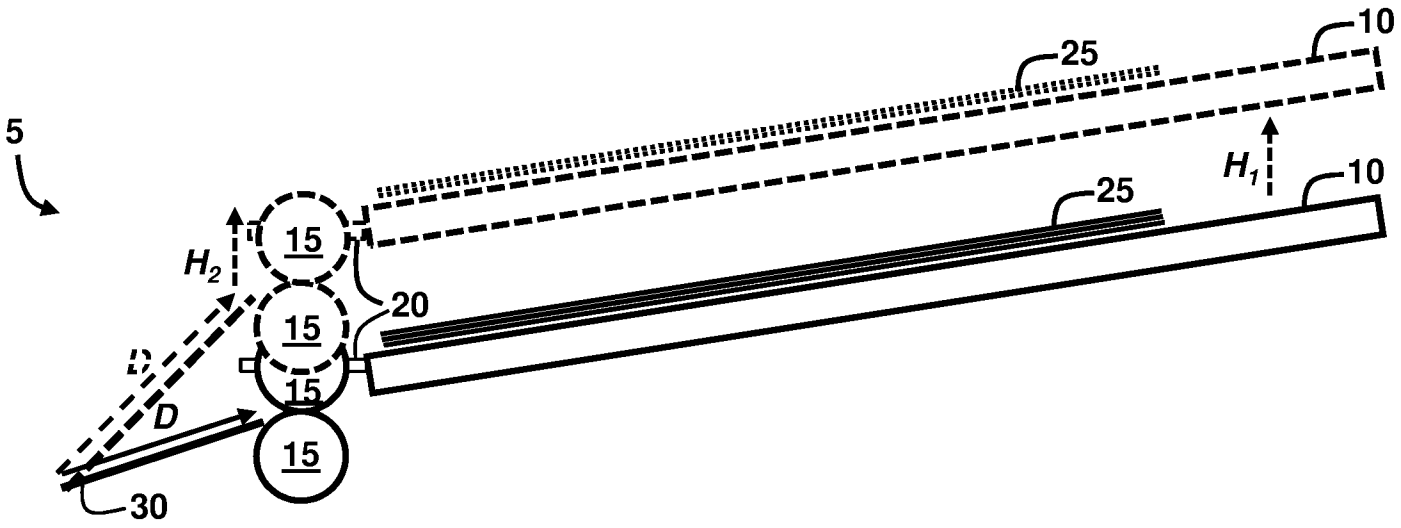
FIG. 1 is a schematic diagram illustrating an automatic document feeder device, according to an example.

FIG. 1 is a schematic diagram illustrating an automatic document feeder device 5, according to an example. The automatic document feeder device 5 comprises a document tray 10, a pair of rollers 15, and at least one controller 20 that automatically adjusts a height $H_1$ of the document tray 10 and the pair of rollers 15 based on the amount of media 25 contained on the document tray 10. A slide 30 is aligned to the pair of rollers 15 to alter the media pathway distance D as the height $H_2$ of the pair of rollers 15 changes.

The media pathway distance D represents the distance that the media 25 travels inside a machine such as a printer, scanner, copier, fax machine, etc. When the height $H_2$ of the pair of rollers 15 changes, then the corresponding media pathway distance D also changes since the distance from the scan modules, which are not shown in FIG. 1, to the output rollers 15 changes. The slide 30 is provided in the area between the scan modules and the output rollers 15 and to allow the media 25 to travel in this area in the machine, and as such the media pathway distance D may be equal to the length of the slide 30 in one example. Accordingly, as the height $H_2$ of the pair of rollers 15 increases; e.g., as the pair or rollers 15 move up, the media pathway distance D increases. Similarly, as the height $H_2$ of the pair of rollers 15 decreases; e.g., as the pair or rollers 15 move down, the media pathway distance D decreases. According to an example, the slide 30 may be any of a flexible, stretchable, bendable, and telescoping slide 30. In such configurations, the slide 30 is able to alter its length and/or angle corresponding to the change of the media pathway distance D required by the movement of the pair of rollers 15. In one example, the slide 30 may comprise Mylar® material allowing for the length of the slide 30 to alter. In another example, the slide 30 may be configured as a tube. In still another example, the slide 30 changes angle but does not change length, wherein the pair of rollers 15 move towards the slide 30 when in the upper position; e.g., the height $H_2$ of the pair of rollers 15 changes by moving upwards. The pair or rollers 15 would move away from the slide 30 when in the lower position. In yet another example, the slide 30 changes angle but does not change length, and the pair of rollers 15 do not move towards or away from the slide 30. Here, the media 25 may jump across a gap from the slide 30 to the pair of rollers 15.

In the various figures, the dashed lines shown for the document tray 10, pair of rollers 15, media 25, controller 20, slide 30, and media pathway distance D represent the positioning of the document tray 10, pair of rollers 15, controller 20, media 25, slide 30, and media pathway distance D after the height adjustment occurs; i.e., after the document tray 10 moves up by height $H_1$ and the pair of rollers 15 move up by height $H_2$. The controller 20 may be either moveable or stationary, e.g., moving or not moving up/down, according to various examples. In one example, the at least one controller 20 adjusts the height $H_1$ of the document tray 10 independently from adjusting the height $H_2$ of the pair of rollers 15. In another example, the at least one controller 20 adjusts the height $H_2$ of the pair of rollers 15 upon adjusting the height $H_1$ of the document tray 10 such that the corresponding adjustments of the heights $H_1$ and $H_2$ of the document tray 10 and the pair of rollers 15 may occur simultaneously, or may be delayed such that the height $H_1$ of the document tray 10 is adjusted first followed by adjustment of the height $H_2$ of the pair of rollers 15 at some certain time delay thereafter.

Figure 2:
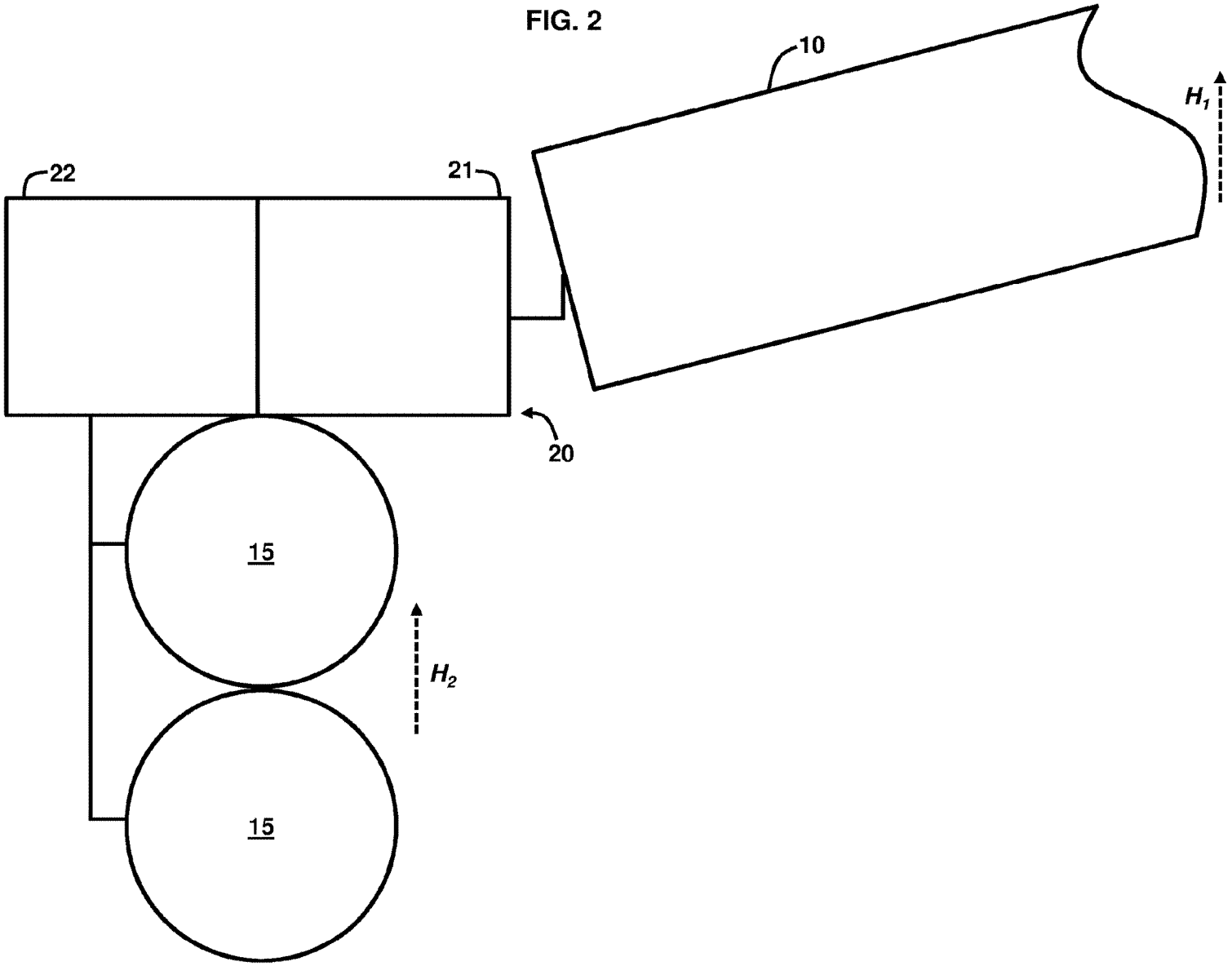
FIG. 2 is a schematic diagram illustrating a controller for an automatic document feeder device, according to an example.

FIG. 2, with reference to FIG. 1, is a schematic diagram illustrating a controller 20 for an automatic document feeder device 5, according to an example. In this example, the at least one controller 20 may comprise a first controller 21 that automatically adjusts the height $H_1$ of the document tray 10, and a second controller 22 that automatically adjusts the height $H_2$ of the pair of rollers 15. The first controller 21 and the second controller 22 may be independently configured or may be controlled by one set of circuits. The first controller 21 and the second controller 22 may include any suitable device used to control motion including, but not limited to, motors, actuators, springs, rack-and-pinion systems, gears, belts, and linkages, among others.

Figure 3A:
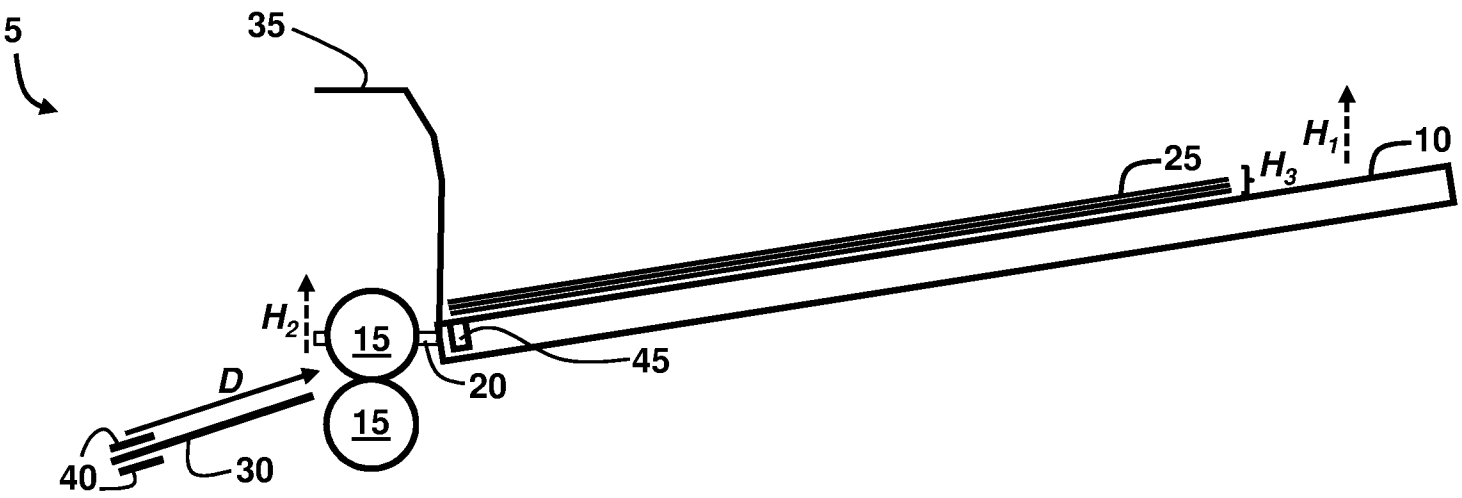
FIG. 3A is a schematic diagram illustrating an automatic document feeder device at a first height, according to an example.
Figure 3B:
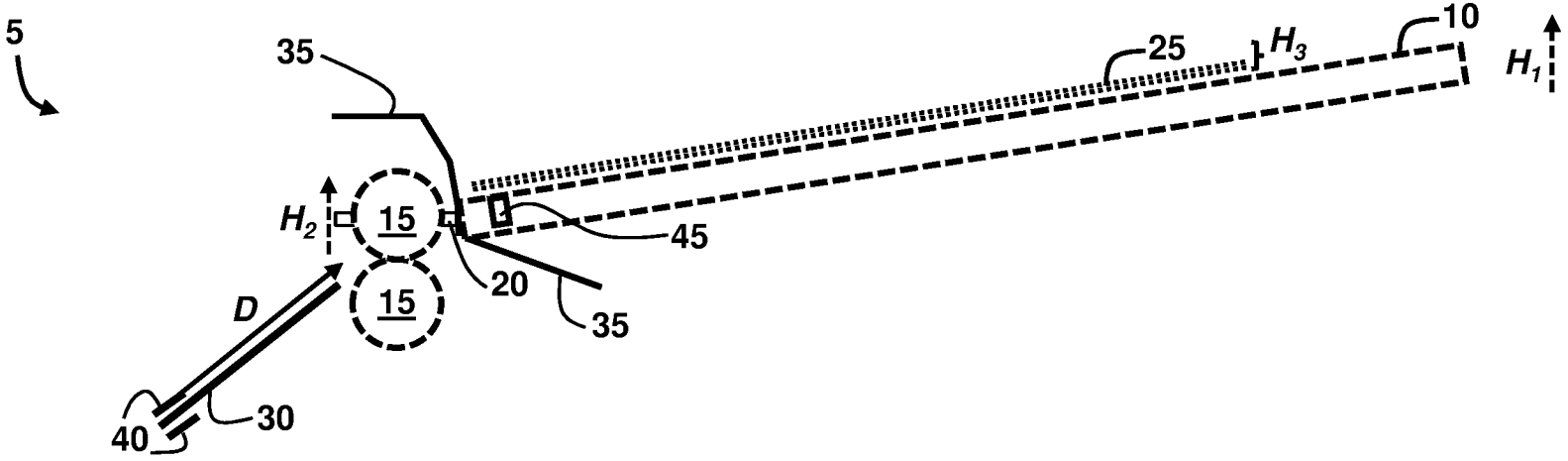
FIG. 3B is a schematic diagram illustrating an automatic document feeder device at a second height, according to an example.

FIGS. 3A and 3B, with reference to FIGS. 1 and 2, are schematic diagrams illustrating an automatic document feeder device 5 and a pair of rollers 15 moving to different heights, according to an example. The device 5 may comprise a guide 35 adjacent to the document tray 10, wherein the guide 35 may bend as the height $H_1$ of the document tray 10 increases; e.g., as the document tray 10 moves up. The guide 35 may be a flexible plastic strip in one example that is spring-loaded causing the guide 35 to bend as the document tray 10 moves up. In an example, the guide 35 separates the document tray 10 from the pair of rollers 15, and as such may act as an end wall or stop for the media 25 loaded onto the document tray 10. The guide 35 may be positioned on the edge of the document tray 10 or it may be positioned through the document tray 10. In an example, the guide 35 bends away from the pair of rollers 15 as the document tray 10 moves up.

The device 5 may comprise a slot 40 retaining at least a portion of the slide 30, wherein the slide 30 is able to move with respect to the slot 40 as the height $H_2$ of the pair of rollers 15 changes. In this configuration, the slide 30 may be rigid or it may be any of a flexible, stretchable, bendable, and telescoping slide 30. Because at least a portion of the slide 30 is positioned in the slot 40, the slide 30 may be rigid such that it moves translationally within the slot 40 to alter the length of the exposed slide 30; e.g., not within the slot 40, between the scan modules and the output rollers 15 in the machine.

The device 5 may comprise a sensor 45 to determine a thickness; e.g., height $H_3$ of the media 25 contained on the document tray 10. The sensor 45 may include an optical sensor, a scale to measure mass/weight, a counter, or any other type of sensing device capable of determining how many sheets of media 25 are on the document tray 10 and the reduction in sheets as the media 25 is continuously fed into the machine until no remaining media 25 remains on the document tray 10. Alternatively, the sensor 45 may comprise a laser rangefinder system, force gauge, or spring force sensor to detect the changes in height $H_1$ of the document tray 10. In one example, the sensor 45 is positioned adjacent to or in the document tray 10. In other examples, the sensor 45 may be positioned at an appropriate location to conduct the suitable sensing activity of the media 25 and/or the document tray 10.

Figure 4A:
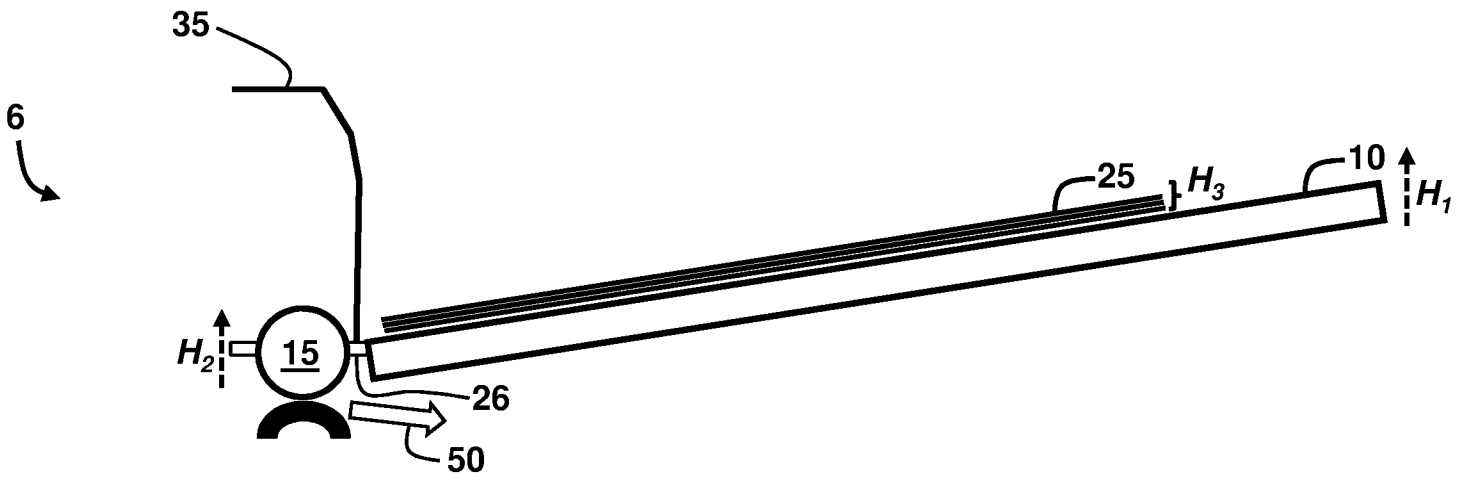
FIG. 4A is a schematic diagram illustrating an automatic document feeder device at a first height configuration, according to another example.
Figure 4B:
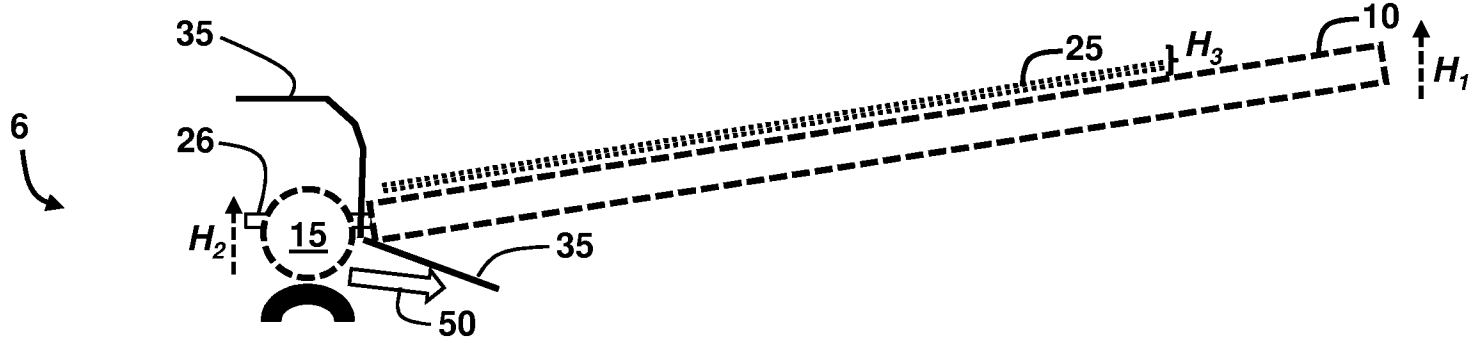
FIG. 4B is a schematic diagram illustrating an automatic document feeder device at a second height configuration, according to another example.
Figure 4C:
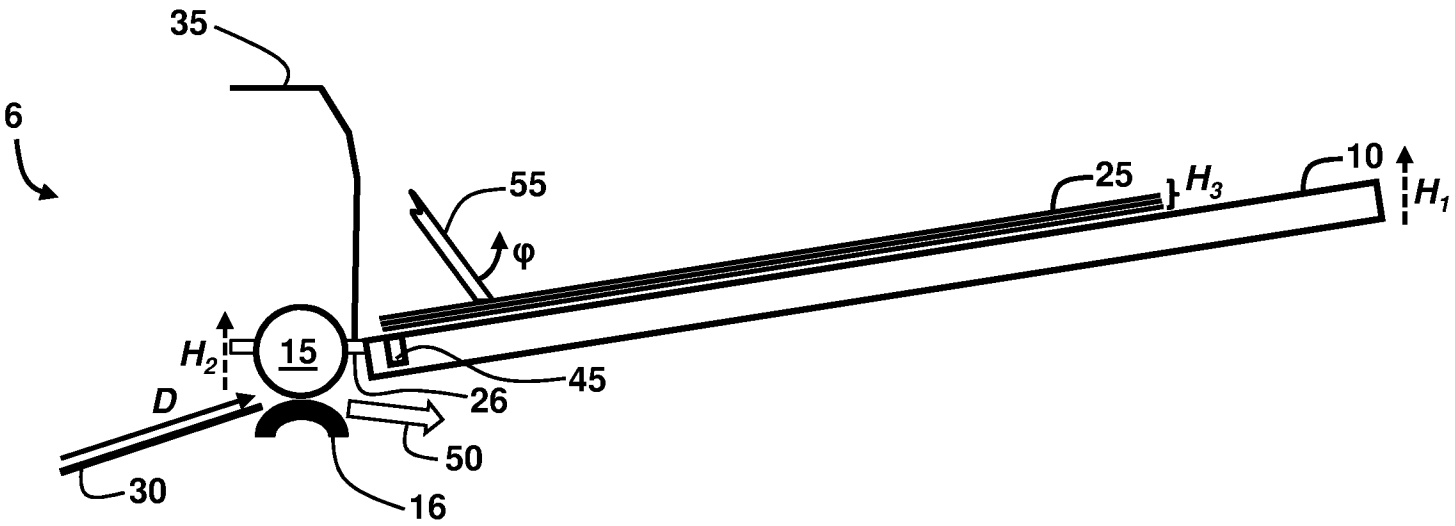
FIG. 4C is a schematic diagram illustrating the automatic document feeder device of FIG. 4A at a first height configuration, according to another example.
Figure 4D:
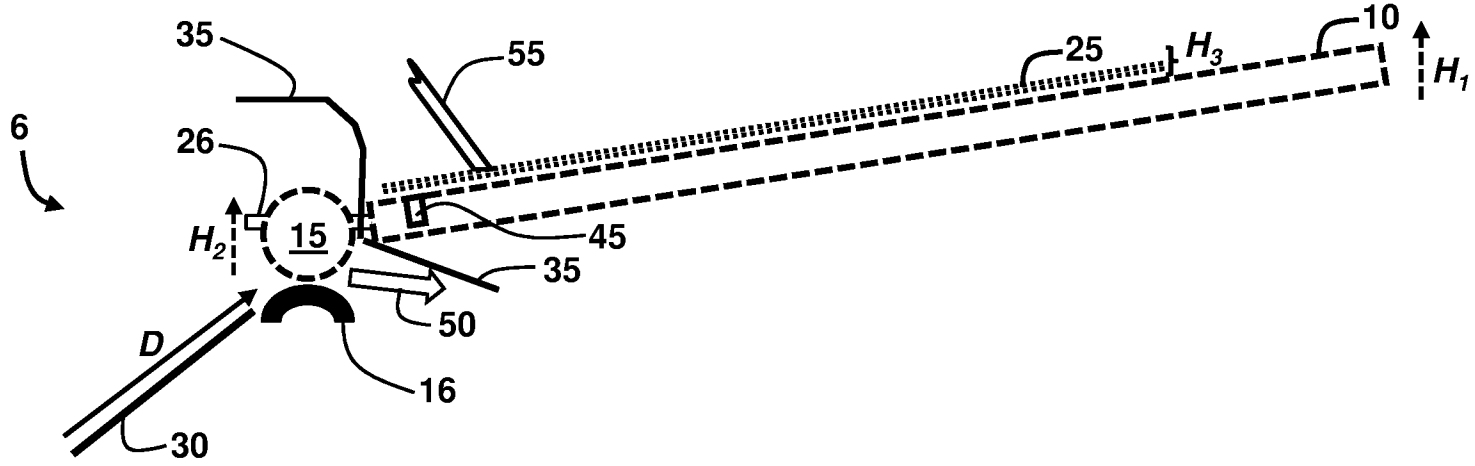
FIG. 4D is a schematic diagram illustrating an automatic document feeder device of FIG. 4B at a second height configuration, according to another example.

FIGS. 4A through 4D, with reference to FIGS. 1 through 3B, illustrate schematic diagrams of an automatic document feeder device 6 according to other examples. FIGS. 4A and 4C illustrate the device 6 at a first height configuration and FIGS. 4B and 4D illustrate the device 6 at a second height configuration. The device 6 comprises an automatic document feeder tray 10, at least one media output roller 15, a control system 26 to automatically adjust a height $H_1$, $H_2$ of the automatic document feeder tray 10 and the at least one media output roller 15 based on a height $H_3$ of media 25 contained on the automatic document feeder tray 10, and a guide 35 in between the automatic document feeder tray 10 and the at least one media output roller 15 to provide a clear media discharge path 50 emanating from the at least one media output roller 15. In an example, only one output roller 15 is provided with a corresponding stationary member 16 with only the one output roller 15 rotating and with the stationary member 16 having no rotation. However, both the output roller 15 and the stationary member 16 may be adjusted in height using the control system 26. The control system 26 may include any suitable device used to control motion including, but not limited to, controllers, motors, actuators, springs, rack-and-pinion systems, gears, belts, and linkages, among other types of devices.

Similar to device 5, in an example, device 6 may comprise a slide 30 aligned to the at least one media output roller 15, wherein the slide 30 alters a media pathway distance D as the height $H_2$ of the at least one media output roller 15 changes. Again, the slide 30 may be rigid or it may be any of a flexible, stretchable, bendable, and telescoping slide 30. The guide 35 may bend away from the at least one media output roller 15 as the height $H_1$ of the automatic document feeder tray 10 increases.

As illustrated in FIGS. 4C and 4D, the device 6 may comprise a mechanism 55 to rest on the media 25 on the automatic document feeder tray 10, and a sensor 45 to determine a pivot angle cp of the mechanism 55 as the height $H_3$ of the media 25 on the automatic document feeder tray 10 decreases. The mechanism 55 may comprise a flexible, plastic arm-like structure, according to one example, such that the mechanism 55 bends as the document tray 10 rises. The rising of the document tray 10 causes the mechanism 55 to pivot creating a rotational or pivot angle cp. The sensor 45 may be communicatively linked to the mechanism 55 to sense the change in the pivot angle cp. This sensing of the pivot angle cp of the mechanism 55 indicates that the document tray 10 has changed height $H_1$, whereby the control system 26 adjusts the height $H_2$ of the at least one media output roller 15.

Figure 5:
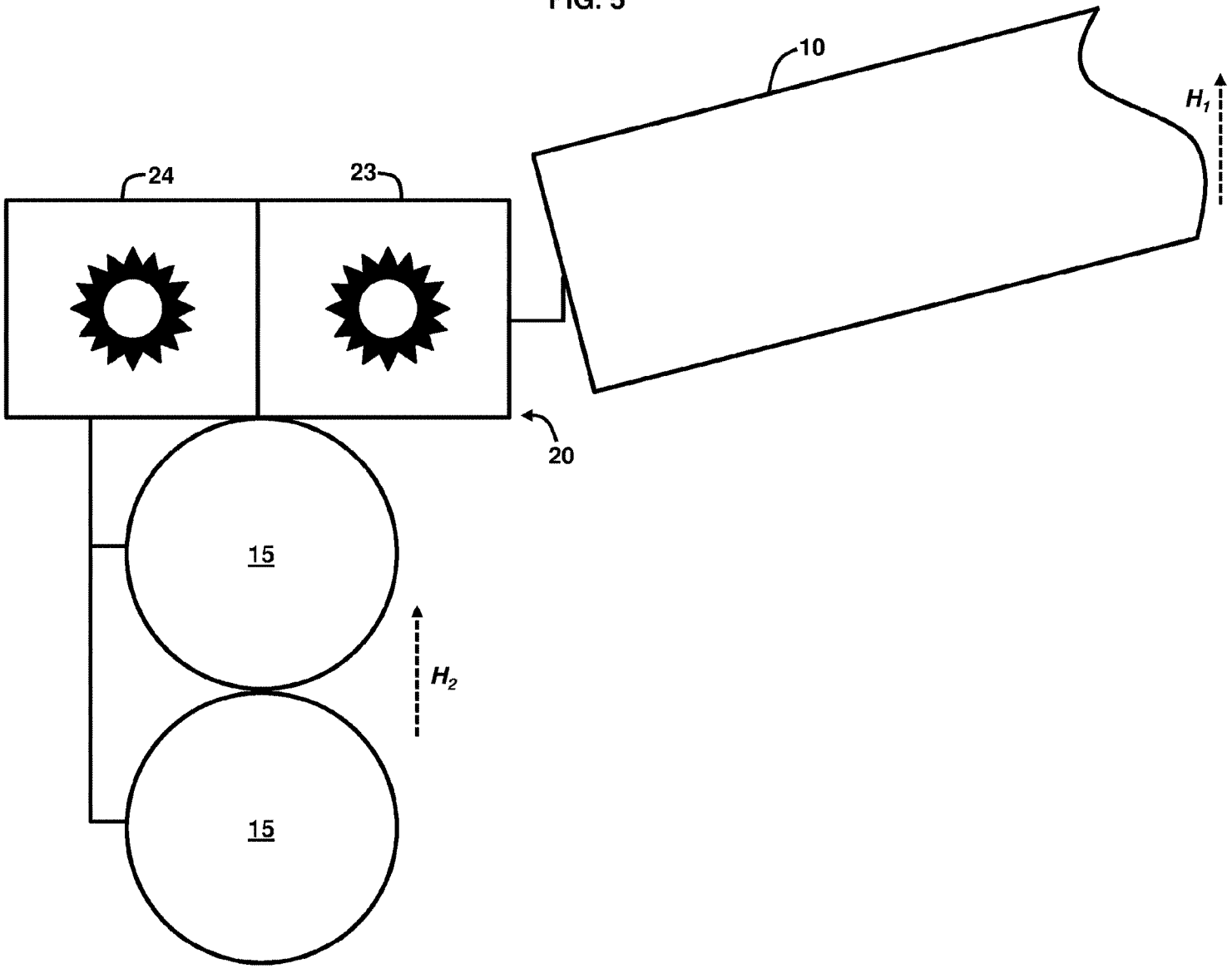
FIG. 5 is a schematic diagram illustrating a control system for an automatic document feeder device, according to another example.

FIG. 5, with reference to FIGS. 1 through 4D, is a schematic diagram illustrating a control system 20 for an automatic document feeder device 6, according to another example. Here, the control system 20 may comprise a first motor 23 to automatically adjust the height $H_1$ of the automatic document feeder tray 10 based on the height $H_3$ of media 25 contained on the automatic document feeder tray 10. The control system 20 may also comprise a second motor 24 to automatically adjust the height $H_2$ of the at least one media output roller 15 based on the height $H_3$ of media 25 contained on the automatic document feeder tray 10.

Figure 6A:
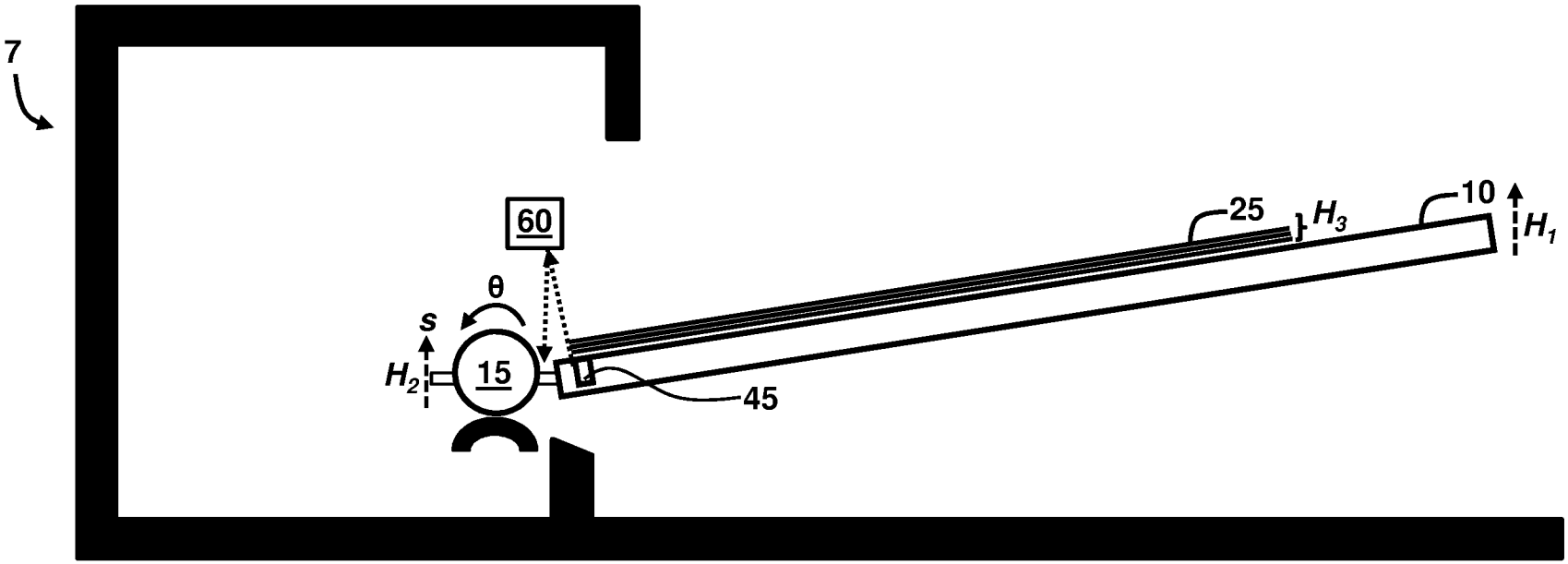
FIG. 6A is a schematic diagram illustrating an apparatus, according to an example.

FIG. 6A, with reference to FIGS. 1 through 5, is a schematic diagram illustrating an apparatus 7, according to an example. The apparatus 7 comprises an automatic document feeder tray 10 to hold media 25, at least one media output roller 15 comprising rotational 6 and translational movement s, a sensor 45 adjacent to the automatic feeder tray 10, and a processor 60 to receive a measurement of a thickness; i.e., height $H_3$, of the media 25 on the automatic document feeder tray 10 from the sensor 45, and send a signal to adjust a height $H_1$, $H_2$ of the automatic document feeder tray 10 and the at least one media output roller 15 based on the measured thickness; i.e., height $H_3$, of the media 25. The processor 60 may be communicatively coupled to the sensor 45 by wired or wireless connection. Moreover, the processor 60 may be part of the machine's central processing unit and may further be linked to an interface panel on the machine, not shown.

Figure 6B:
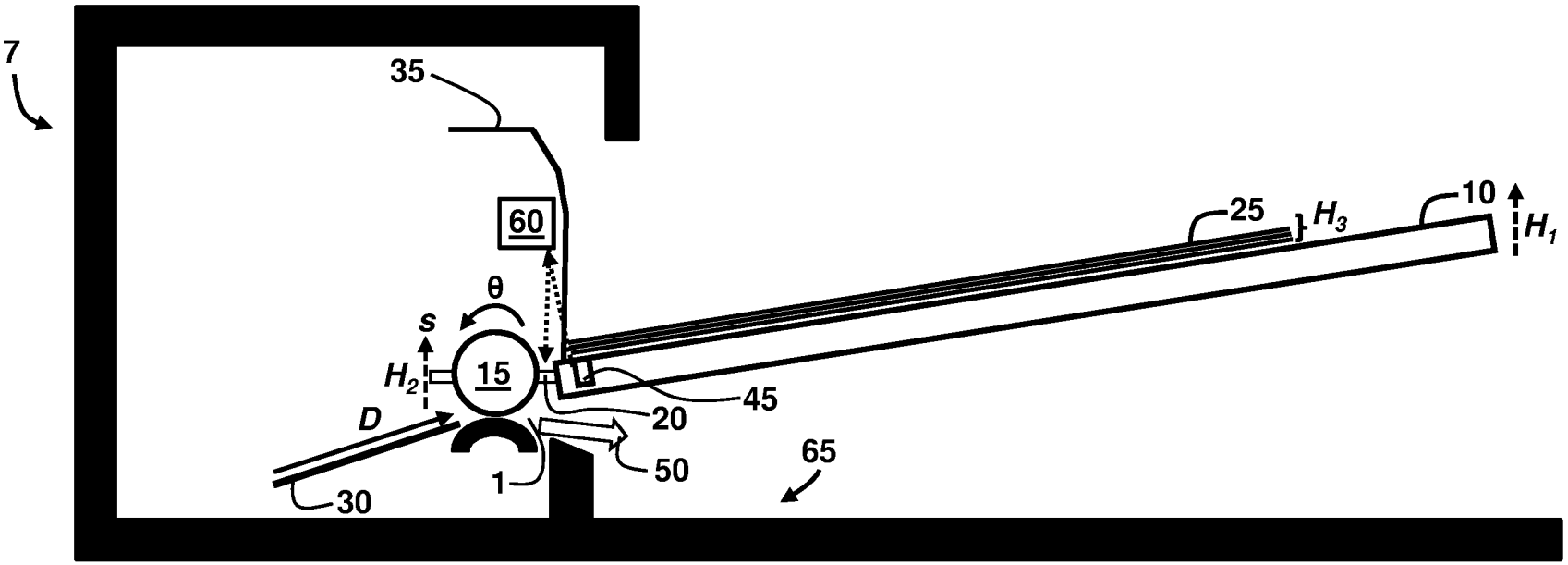
FIG. 6B is a schematic diagram illustrating an apparatus, according to another example.

FIG. 6B, with reference to FIGS. 1 through 6A, is a schematic diagram illustrating the apparatus 7, according to another example. Here, the apparatus 7 may comprise a slide 30 aligned to the at least one media output roller 15, wherein the slide 30 is to alter a media pathway distance D for the media 25 as the at least one media output roller 15 translationally moves s. A guide 35 is provided to separate the automatic document feeder tray 10 from the at least one media output roller 15. The guide 35 may serve as an end wall or stop for the media 25 loaded on the automatic document feeder tray 10. The guide 35 provides an unobstructed media discharge path 50 between a discharge 1 of the at least one media output roller 15 and an area 65 underneath the automatic document feeder tray 10. In one example, when the automatic document feeder tray 10 and at least one media output roller 15 are at the initial heights; e.g., lower heights, the guide 35 does not extend beyond the bottom of the automatic document feeder tray 10, and as such the media discharge path 50 between the discharge 1 of the at least one media output roller 15 and the area 65 underneath the automatic document feeder tray 10 is unobstructed. Moreover, because the guide 35 is configured to bend away from the at least one media output roller 15, as the automatic document feeder tray 10 and the at least one media output roller 15 rise, the media discharge path 50 between the discharge 1 of the at least one media output roller 15 and the area 65 underneath the automatic document feeder tray 10 is unobstructed. The unobstructed media discharge path 50 permits media 25 that is output from the at least one media output roller 15 to easily discharge from the machine onto the discharge tray; e.g., area 65, without become entangled. Furthermore, since the height $H_1$ of the automatic document feeder tray 10 rises, the area 65 to receive discharged media 25 is sufficiently spaced to suitably accommodate all of the discharged media 25. The apparatus 7 shown in FIGS. 6A and 6B illustrate one output roller 15. However, a pair of output rollers 15 may be incorporated into the apparatus 7. In one example, the processor 60 sends the signal to adjust the height $H_2$ of the at least one media output roller 15 after the automatic document feeder tray 10 has changed height $H_1$ to a certain level. The signal may result in the at least one media output roller 15 to adjust in height $H_2$ a certain time delay after the automatic document feeder tray 10 has changed height $H_1$, or both heights $H_1$, $H_2$ may be adjusted simultaneously. However, to prevent obstruction of the media discharge path 50, the at height adjustment of the at least one media output roller 15 would not happen prior to the height adjustment of the automatic document feeder tray 10.

Figure 7A:
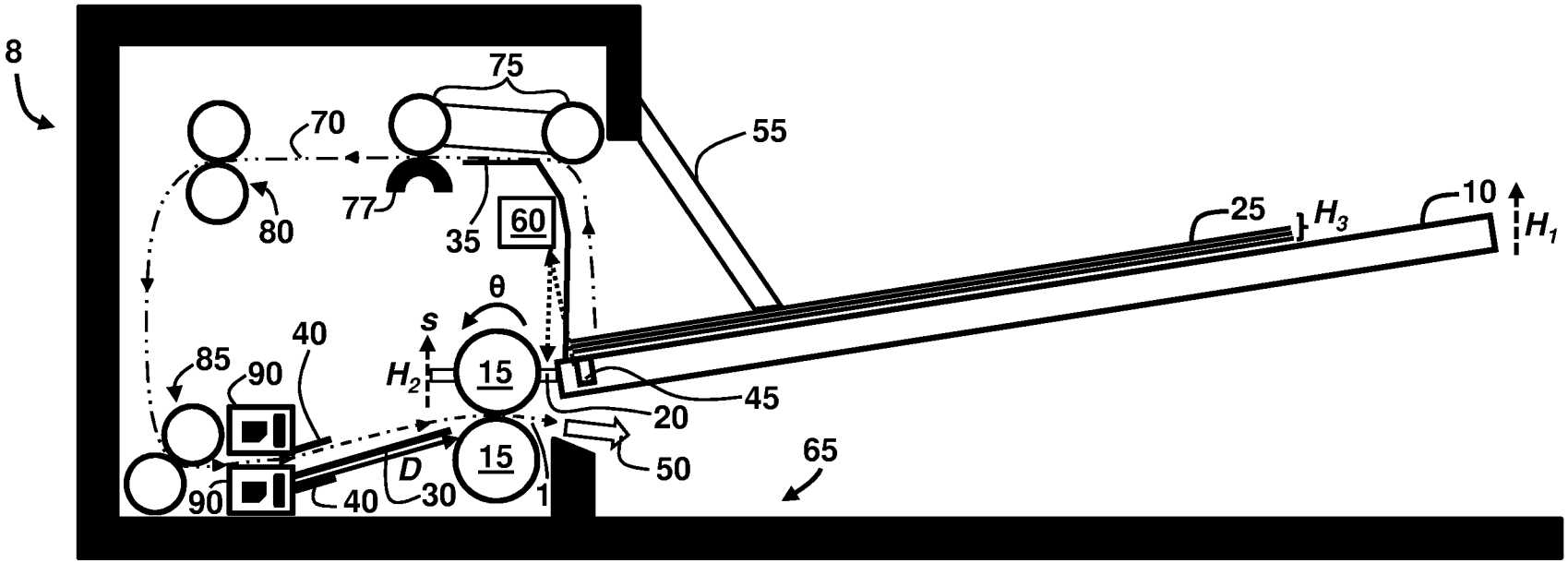
FIG. 7A is a schematic diagram illustrating a machine with a document tray and output rollers in a first configuration, according to an example.
Figure 7B:
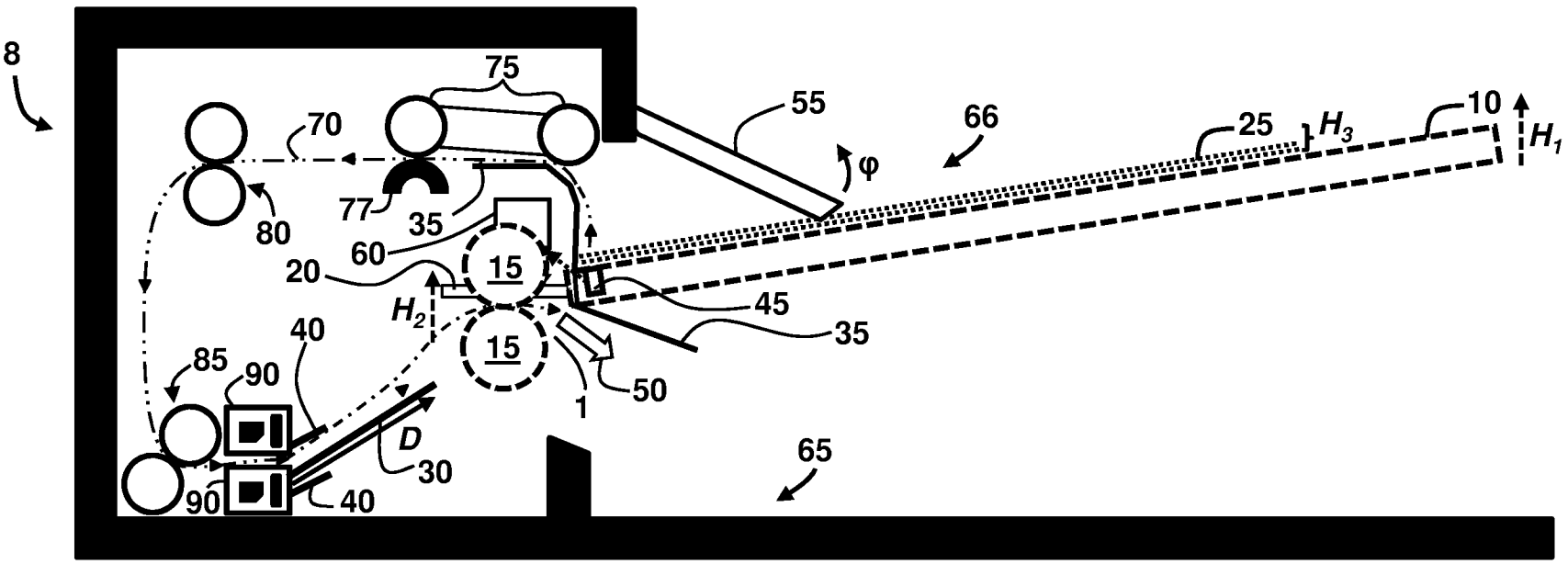
FIG. 7B is a schematic diagram illustrating a machine with a document tray and output rollers in a second configuration, according to an example.
Figure 7C:
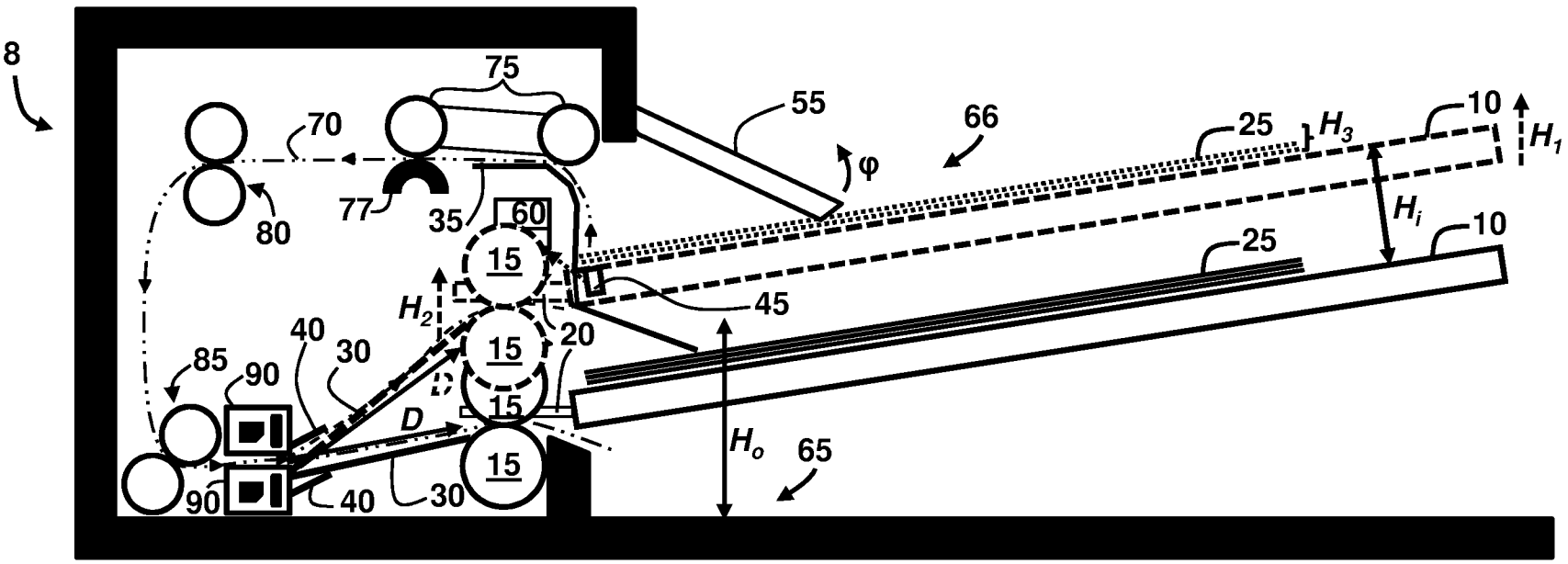
FIG. 7C is a schematic diagram illustrating a machine with a document tray and output rollers moving from a first configuration to a second configuration, according to an example.

FIGS. 7A and 7B, with reference to FIGS. 1 through 6B, are schematic diagrams illustrating a machine 8 in different configurations, according to an example. FIG. 7C, with reference to FIGS. 1 through 7B, is a schematic diagram illustrating a machine 8 with a document tray 10 and output rollers 15 moving from a first configuration to a second configuration, according to an example herein. The machine 8 may comprise a printer, scanner, copier, and/or fax machine, etc. FIGS. 7A and 7B illustrate the path 70 of media 25 from the document tray 10 into and through the machine 8, and then out of the machine 8. Media 25, which may include one or more sheets of paper, film, transparencies, fabric, photographs, or other types of sheets, is placed on the document tray 10. An adjustable pair of input rollers 75 grab the uppermost sheet of media 25. The guide 35 assists the pair of input rollers 75 input the media 25 into the machine 8. A separation pad 77 may be aligned with one of the input rollers 75 to help pick and separate the media 25 as it enters the machine 8. Other pairs of drive rollers 80, 85 may be appropriately positioned in the machine 8 to guide the media 25. The pair of drive rollers 85 guide the media 25 to one or more scan modules 90. A slide 30 is positioned adjacent to the scan modules 90, wherein the length of the slide 30 defines a media pathway distance D. The slide 30 may be rigid or it may be any of a flexible, stretchable, bendable, and telescoping slide 30. A slot 40 may be positioned adjacent to the scan modules 90, wherein the slot 40 may retain at least a portion of a slide 30. The slide 30 leads the media 25 towards one or more output rollers 25. The media 25 exits the machine 8 in a discharge path 50, which is between the discharge 1 of the output rollers 15 and an area 65 underneath the automatic document feeder tray 10.

As subsequent sheets of the media 25 are fed into the machine 8, the number of sheets of media 25 on the document tray 10 becomes reduced. This reduction in the number of sheets of media 25 is detected by the sensor 45. In various examples, the sensor 45 may detect the change in the number of sheets of media 25 optically or by weight. In another example, a flexible mechanism 55 rests on the media 25, which pivots based on any of the sensed change in height $H_3$ of the media 25 and the change in height $H_1$ of the document tray 10, whereby the sensor 45 may detect the resulting change in the pivot angle φ of the mechanism 55. The sensor 45 may directly send a signal to one or more controllers 20 that control the height adjustments $H_1$, $H_2$ of the document tray 10 as well as the one or more rollers 15, respectively. Alternatively, the sensor 45 sends a signal to a processor 60, which then sends a corresponding signal to the one or more controllers 20 for performing the height adjustments $H_1$, $H_2$. As the number of sheets of media 25 become smaller due to being fed into the machine 8, the one or more controllers 20 automatically move the document tray 10 upwards without requiring user intervention to facilitate the adjustment of the document tray 10.

As the document tray 10 rises, the one or more controllers 20 adjust the height $H_2$ of the one or more rollers 15. In this regard, not only do the one or more rollers have rotational motion 6 to facilitate the discharge of the media 25 out of the machine, but the one or more rollers 15 also have translational motion s corresponding to the adjustment of the height $H_2$. In one example, the adjustment of the $H_2$ of the one or more rollers 15 may be in the range of approximately 20-100 mm. The guide 35 bends away from the one or more rollers 15 thereby creating an unobstructed media discharge path 50 to facilitate an easy discharge of the media 25 from the machine 8 and onto the area 65; e.g., discharge tray, underneath the document tray 10.

The upward movement of the document tray 10 and the one or more rollers 15 creates a proportionally open area 65 under the document tray 10 such that the total height of the machine 8 does not change; only the height of the document tray 10 in relation to the area 65 under the document tray 10 changes. In other words, as the height of the document tray 10 increases, the area 65 under the document tray 10 also increases, but the area 66 above the document tray 10 decreases, thereby resulting in no change in the vertical/height footprint of the machine 8. As indicated in FIG. 7C, the input height H; of the document tray 10 and the output height $H_0$ of the area 65 underneath the document tray 10 is significantly increased without increasing the overall height of the machine 8. Accordingly, the examples provided herein permit the automatic document feeder input capacity to increase without increasing the overall automatic document feeder height. Once the print/scan/copy/fax job is completed, the document tray 10 and one or more rollers 15 revert back to the original positions; e.g., lower positions.

The present disclosure has been shown and described with reference to the foregoing exemplary implementations. Although specific examples have been illustrated and described herein it is manifestly intended that the scope of the claimed subject matter be limited only by the following claims and equivalents thereof. It is to be understood, however, that other forms, details, and examples may be made without departing from the spirit and scope of the disclosure that is defined in the following claims.

What is claimed is:

1. An automatic document feeder device comprising:

a document tray;

a pair of rollers;

at least one controller that automatically adjusts a height of the document tray and the pair of rollers based on an amount of media contained on the document tray, wherein the at least one controller is to adjust the height of the document tray independently from adjusting the height of the pair of rollers; and a slide aligned to the pair of rollers to alter a media pathway distance as the height of the pair of rollers changes.

2. The automatic document feeder device of claim 1, wherein the at least one controller comprises a first controller that automatically adjusts the height of the document tray, and a second controller that automatically adjusts the height of the pair of rollers.

3. The automatic document feeder device of claim 1, comprising a guide adjacent to the document tray, wherein the guide is to bend as the height of the document tray increases.

4. The automatic document feeder device of claim 1, wherein the slide comprises any of a flexible, stretchable, bendable, and telescoping slide.

5. The automatic document feeder device of claim 1, comprising a slot retaining at least a portion of the slide, wherein the slide is to move with respect to the slot as the height of the pair of rollers changes.

6. The automatic document feeder device of claim 1, comprising a sensor to determine a thickness of media contained on the document tray.

7. A device comprising:

an automatic document feeder tray;

at least one media output roller;

a control system to automatically adjust a height of the automatic document feeder tray and the at least one media output roller based on a height of media contained on the automatic document feeder tray, wherein the control system is operable to adjust the height of the automatic document feeder tray independently from adjusting the height of the at least one media output roller; and a guide in between the automatic document feeder tray and the at least one media output roller to provide a clear media discharge path emanating from the at least one media output roller.

8. The device of claim 7, comprising a slide aligned to the at least one media output roller, wherein the slide is to alter a media pathway distance as the height of the at least one media output roller changes.

9. The device of claim 7, wherein the guide is to bend away from the at least one media output roller as the height of the automatic document feeder tray increases.

10. The device of claim 7, comprising:

a mechanism to rest on the media on the automatic document feeder tray; and a sensor to determine a pivot angle of the mechanism as the height of the media on the automatic document feeder tray decreases.

11. The device of claim 7, wherein the control system comprises:

a first motor to automatically adjust the height of the automatic document feeder tray based on the height of media contained on the automatic document feeder tray; and a second motor to automatically adjust the height of at least one media output roller based on the height of media contained on the automatic document feeder tray.

12. An apparatus comprising:

an automatic document feeder tray to hold media;

at least one media output roller comprising rotational and translational movement;

a sensor adjacent to the automatic feeder tray; and a processor to:

receive a measurement of a thickness of the media on the automatic document feeder tray from the sensor; and send a signal to adjust a height of the automatic document feeder tray and the at least one media output roller based on the measured thickness of the media, wherein the processor is operable to adjust the height of the automatic document feeder tray independently from adjusting the height of the at least one media output roller.

13. The apparatus of claim 12, comprising:

a slide aligned to the at least one media output roller, wherein the slide is to alter a media pathway distance for the media as the at least one media output roller translationally moves; and a guide separating the automatic document feeder tray from the at least one media output roller, wherein the guide is to provide an unobstructed media discharge path between a discharge of the at least one media output roller and an area underneath the automatic document feeder tray.

14. The apparatus of claim 12, wherein the processor is to send the signal to adjust the height of the at least one media output roller after the automatic document feeder tray has changed height to a certain level.

* * * * *